United States Patent [19]

De Rycke

[11] Patent Number: 4,775,614

[45] Date of Patent: Oct. 4, 1988

[54] METHOD FOR FIXING A PHOTOGRAPHIC SILVER HALIDE EMULSION LAYER MATERIAL

[75] Inventor: Gino L. De Rycke, Mortsel, Belgium

[73] Assignee: Agfa-Gevaert N.V., Mortsel, Belgium

[21] Appl. No.: 920,360

[22] Filed: Oct. 20, 1986

[30] Foreign Application Priority Data

Oct. 28, 1985 [EP] European Pat. Off. ..... 85201740.9

[51] Int. Cl.[4] ..... G03C 5/54; G03C 5/38

[52] U.S. Cl. ..... 430/390; 430/203; 430/206; 430/231; 430/236; 430/247; 430/251; 430/428; 430/429; 430/404

[58] Field of Search ..... 430/206, 404, 428, 429, 430/231, 203, 236, 247, 251, 390

[56] References Cited

U.S. PATENT DOCUMENTS

| | | | |
|---|---|---|---|
| 2,698,245 | 12/1954 | Lard | 430/231 |
| 2,740,717 | 4/1956 | Yutzy et al. | 430/206 |
| 2,882,151 | 4/1959 | Yutzy et al. | 430/206 |
| 3,179,517 | 4/1965 | Tregillus et al. | 430/206 |
| 3,396,018 | 8/1968 | Beavers et al. | 430/231 |
| 3,647,464 | 3/1972 | Smith et al. | 430/206 |

FOREIGN PATENT DOCUMENTS 0746174 3/1956 United Kingdom .

*Primary Examiner*—Richard L. Schilling
*Attorney, Agent, or Firm*—William J. Daniel

[57] ABSTRACT

An ecologically advantageous method for fixing a developed photographic silver halide emulsion layer material which involves the steps of:

(A) developing an image-wise exposed silver halide emulsion layer with a developing agent in the presence of an aqueous alkaline liquid, (B) bringing the developed photographic material while still wet with the liquid of step (A) with its silver halide emulsion layer side in intimate contact with a water-absorbing layer of a receptor element, which layer comprises an organic hydrophilic colloid binder, a silver halide complexing agent, and in dispersed form a metal sulphide as silver ion scavenging agent, (C) maintaining said photographic material and receptor element in contact to allow the transfer of dissolved complexed silver compound into said receptor element, and (D) separating the photographic material from the receptor element, and wherein said water-absorbing layer contains said metal sulphide in colloidal form with an average grain size below 0.1 μm, and in an amount at a sulphide ion coverage per m2 at least stoichiometrically equivalent with the silver ion coverage per m2 in the photographic material in its unexposed and undeveloped state, the molar coverage per m2 of said complexing agent being not lower than 1/20 of the molar coverage per m2 of silver halide in the undeveloped photographic material.

18 Claims, No Drawings

METHOD FOR FIXING A PHOTOGRAPHIC SILVER HALIDE EMULSION LAYER MATERIAL

DESCRIPTION

The present invention relates to a method for rapid and ecologically clean processing of a photographic silver halide emulsion element wherein the removal of undeveloped silver halide from a developed photographic element is accomplished with a particularly small amount of liquid in a receptor or absorbing element containing a silver ion complexing agent and silver ion precipitating agent or scavenging agent.

Silver halide emulsion materials with all their enormous advantages in sensitivity, spectral sensitisation and capability of producing black-and-white and colour images with strong optical density and high resolving power have the drawback of requiring in conventional processing several processing liquids and a time consuming drying for the final image. Particularly the fixing and rinsing steps are of relatively long duration when archival image quality is desired. Moreover, exhausted fixing liquids and even wash liquids containing dissolved silver pose an ecological problem because silver ions only in a very limited quantity of silver ions are permitted to be drained off into the sewer. Further, silver recovery from fixing liquids in large scale processing is nowadays a must for its economic importance and is achieved by the deposition of dissolved silver as metal or silver precipitate from the fixing liquid bulk.

Under the impulse of these specific drawbacks and requirements associated with the conventional processing of photographic silver halide emulsion materials there has been a constant search for a rapid ecologically clean processing technique that is dry as possible and makes possible archival high quality images.

In a successful rapid access processing known as diffusion transfer reversal (DTR-) processing, an exposed silver halide emulsion material is developed and non-developed imagewise silver halide is complexed and transferred by diffusion into an image-receiving material to form therein a silver image by reduction with the aid of a developing agent in the presence of minute amounts of so-called development nuclei, e.g. colloidal silver or heavy metal sulphides, acting as catalyst for the reduction. Many efforts and much research have been devoted to obtain diffusion transfer images of high quality in the image receiving material with reduced amount of silver halide in the light-sensitive material as compared with the conventional processing. These efforts and research directed to a large choice of development nuclei, black-toning agents, binding agents, etc . . . , led for many purposes to satisfactory image quality in the image receiving material. In some fields of image reproduction, e.g. the graphic art field, however, where in some applications utmost sharpness or other extreme sensitometric qualities are required, the formation of the final image in the photosensitive material by conventional processing, i.e. image formation not based on diffusion transfer of image forming substances, is still preferred.

In a rapid access processing method described by Tregillus in GB-P 964,514 and U.S. Pat. No. 3,179,517 an exposed photographic silver halide emulsion layer is developed and fixed simultaneously, the method comprising the following steps:

(A) bringing the exposed layer into intimate contact with a water-absorbent, organic colloid processing web under the following conditions:

(i) either the exposed layer or the web has been preimbibed with aqueous liquid, (ii) a photographic silver halide developing agent has been incorporated either in the emulsion layer or in the web before contact, provided that where the developing agent has been incorporated in the emulsion layer, development is not allowed to commence before contact, (iii) the processing web has incorporated therein before contact an organic amine-sulphur dioxide addition product, at least one silver halide solvent and sufficient silver precipitating agent to precipitate the whole of the silver halide complex which will diffuse into the web during step (B);

(B) maintaining the emulsion layer and processing web in contact until development of a silver image in the emulsion layer is complete and substantially all the silver halide has migrated from the emulsion layer and precipitated in the processing web; and (C) separating the emulsion layer from the processing web.

From experiments it was learned that by the competitive fixing and development reactions a part of the exposed silver halide of a negative working silver halide emulsion layer becomes dissolved by the silver halide complexing agent and diffuses into the web, which results in a decreased image density in the developed emulsion layer of the photographic material.

Further it has been established experimentally by us that in reproducing Example 10 of U.S. Pat. No. 3,179,517 wherein zinc sulphide is used as silver ion precipitating agent, the developing activity of the developing agent incorporated in said web becomes rapidly lost which is probably due to the absence in the described web composition of the amine-sulphur dioxide addition product.

It has still further been established experimentally by us that an increase in the ratio by weight of a metal sulphide as scavenging agent for silver ions to fixing agent in the Tregillus process favours the fixing speed but at the expense of maximum image density. Moreover, it has been established by us that the procedure of said Example 10 yields an image having a brown stain and rather high brown fog in the non-image area.

It is an object of the present invention to provide a method for a rapid and ecologically clean processing of an exposed photographic silver halide emulsion element using a fairly small amount of liquid and yielding images of high quality without prolonged drying.

It is further one of the objects of the present invention to provide a stable receptor element for use in said method and wherefrom silver can be easily recovered.

Other objects and advantages of the present invention will appear from the further description.

According to the present invention there is provided a method for processing an exposed photographic silver halide emulsion material which method comprises the steps:

(A) developing an image-wise exposed silver halide emulsion layer by means of (a) developing agent(s) using an aqueous alkaline liquid having preferably a pH at least 9, more preferably at least 11, (B) bringing the developed photographic material while being still wet with the liquid used in step (A) with its silver halide emulsion layer side in intimate contact with a water-absorbing layer of a receptor element, preferably sheet or web, that contains in an organic hydrophilic colloid binder a silver halide complexing agent, also called silver halide solvent, and in dispersed form a metal sulphide as silver ion scavenging agent, (C) maintaining said photographic material and receptor element in contact to allow the transfer of dissolved complexed silver compound into said receptor element until removal of undeveloped silver halide from the exposed silver halide emulsion layer is substantially completed and a silver sulphide precipitate is formed in the receptor element, and (D) separating the photographic material from the receptor element, and wherein said water-absorbing layer contains said metal sulphide in colloidal form with an average grain size below 0.1 μm, and in an amount at a sulphide ion coverage per m2 at least stoichiometrically equivalent with the silver ion coverage per m2 in the photographic material in unexposed and undeveloped state, the molar coverage per m2 of said complexing agent being not lower than 1/20 of the molar coverage per m2 of silver halide in the unexposed emulsion layer.

The present process offers particularly rapid access to the fixed photographic print when the photographic material in exposed state contains already the necessary developing agent(s) and the processing is carried out with an aqueous alkaline liquid, called activator liquid, having preferably a pH at least 10, more preferably at least 11.

The activator liquid optionally contains in admixture to its alkali some silver halide solvent.

In a particular embodiment the silver halide emulsion materials contain together with the necessary developing agent(s) a thermosensitive base releasing agent, so that after image-wise exposure and heating of the photographic material for releasing a free base, the liquid treatment of the photographic material may proceed with plain water to start and effect development with the chemicals present in the photographic material. Typical base-releasing agents for use in such photographic materials are described in GB-P 998,949.

It has been found experimentally by us that the treatment of the developed photographic material with an acid stop bath or neutral rinsing liquid only retards access to the final image not only because such treatment takes time but lowering the pH in the photographic material and receptor element slows down the speed of fixing and silver sulphide precipitation.

Silver sulphide fog formation in the photographic material is substantially avoided by contacting the still wet developed photographic material with an initially dry receptor element.

According to a preferred embodiment the above processing steps (B) and (C) are carried out in the presence of sodium bromide.

The use of sodium bromide, preferably applied in the receptor element, substantially retards fog formation that may occur by silver sulphide deposition in the photographic material.

A preferred receptor element according to the present invention contains on a support a water-absorbing receptor layer comprising a hydrophilic organic colloid as binding agent, a silver halide complexing agent and a metal sulphide in dispersed form capable of precipitating silver ions as silver sulphide, said layer being free from silver halide developing agent, said sulphide being present in colloidal form with an average grain size below 0.1 μm at a coverage of at least 5 millimole per m2, and the coverage of said complexing agent being not lower than 0.5 millimole per m2, characterized in that said layer contains sodium bromide.

A particularly useful coverage of sodium bromide in the receptor element is in the range of 0.1 g/m2 to 1.5 g/m2.

The absence of potassium ions from the processing liquid and the receptor element lends to reduce swelling of a gelatin binder used in the processing element, whereby sticking is avoided.

According to a preferred embodiment for particularly rapid removal of the undeveloped silver halide from the exposed photographic material, the sulphide coverage per m2 is at least 25%, more preferably at least 50%, in excess over the stoichiometric amount corresponding with the silver halide coverage per m2 in the undeveloped silver halide emulsion material.

In particularly practical embodiments the said receptor element is used in the form of a web or sheet.

Normally a quantity of developer liquid in the range of 20 to 60 ml per m2 is absorbed by the photographic material. The receptor layer thus acts as a kind of sponge and makes it possible to obtain very rapidly almost dry photographic copies after completing the scavenging of the undeveloped complexed silver halide in said receptor layer.

Any known silver halide solvent may be used in the process of the present invention but best results are obtained with a watersoluble thiosulphate such as sodium thiosulphate. The coverage of such thiosulphate in the receptor element is preferably in the range of 0.50 to 5 g per m2.

These relatively small amounts of silver halide solvent are sufficient since the latter is regained in the precipitation of the complexed silver as silver sulphide and will be used in complexing again and again till complete extraction of the silver halide from the silver halide emulsion layer.

The transfer of silver ions in complexed form is not essential when processing a photographic material wherein the silver halide is silver chloride since silver chloride inherently already has a fairly high solubility product. However, in the absence of silver halide solvent the process of fixing becomes much too slow for practical purposes.

Metal sulphides preferred for use according to the present invention are of the group having a solubility product lower than silver chloride in water but having a higher solubility product than silver sulphide at the applied processing temperature. Particularly rapid access processing is obtained with colloidal zinc sulphide. Fairly good results are obtained with nickel sulphide and lead sulphide. The colloidal sulphides may be mixed or may contain traces of other metals that do not increase substantially their water-solubility.

The preparation of said sulphides in colloidal state proceeds e.g. in aqueous medium by mixing a solution of a corresponding water-soluble metal salt with hydrogen sulphide or a solution of a water-soluble ammonium or alkali metal sulphide. The colloidal product formed by said mixing is freed, e.g. by washing, from residual salt so that no excess of free sulphide and salt formed in the reaction is present. During the precipitation of the colloidal poorly water-soluble metal sulphide optionally a hydrophilic colloid, e.g. gelatin, may be present.

For use in combination with commercially available black-and-white photographic silver halide emulsion materials the receptor element, e.g. sheet or web, of the present invention preferably has a coverage of colloidal sulphide in the range of $5.10^{-3}$ mole to $2.5.10^{-2}$ mole per m2 which is necessary for sufficiently complete fixing of said silver halide emulsion materials having normally a silver halide coverage in a range corresponding with 1.7 g to 8.5 g of silver nitrate per m2.

Suitable hydrophilic organic colloids as binding agent in the water-absorbing layer of the processing element used according to the present invention are of the type known from photographic silver halide emulsion materials. Examples of useful hydrophilic colloid binding agents are: gelatin, polyvinyl alcohol, polyvinyl pyrrolidinone, polyacrylamide, methyl cellulose and carboxymethyl cellulose that may form coating solutions with fairly high viscosity.

When using polyvinyl alcohol as a saponification product of a polyvinyl ester, the polyvinyl ester content, e.g. the content of polyvinyl acetate, is preferably not more than 5 mole % in the polymer.

Other ingredients that may be present in the water-absorbing layer, e.g. for reducing stickiness, are polymers applied from an aqueous polymer dispersion, i.e. latex. For that purpose polymethyl methacrylate latex is particularly useful.

The thickness of the water-absorbing layer is e.g. from 1 μm to 100 μm preferably in the range of 5 μm to 50 μm. The organic hydrophilic colloid binder is preferably present in the range of 2 to 12 g per m2.

The hydrophilic colloid binding agent may be used in admixture with colloidal silica (silica gel) which allows a faster diffusion of complexed silver halide than gelatin.

It has been established experimentally by us that the presence of colloidal silica in the receptor layer improves to some degree the speed of fixing.

Colloidal silica suited for the purpose of the present invention is commercially available, e.g. as SANTOCEL C (trade name of Monsanto Chemical Company, St. Louis, Mo., U.S.A.) and as dispersions of hydrated silica, e.g., sold under the trade name LUDOX LS (LUDOX is a trade name of E. I. du Pont de Nemours & Co., Inc., Wilmington, Del., U.S.A. for a 30% by weight aqueous dispersion of silica), SYTON X-30 (trade name of Monsanto Chemical Company, St. Louis, Mo., U.S.A. for a 30% by weight aqueous dispersion of silica particles having an average particle size of 25 nm) and KIEZELSOL 300-F a colloidal silica having an average particle size of 7–8 nm being marketed by Farbenfabriken Bayer AG, W-Germany.

In a receptor sheet or web of the present invention said water-absorbing layer containing the silver ion scavenging agent and any other layer as described above is applied on a support that is preferably flexible. Particularly suited supports are paper supports and resin supports of the type known in photographic silver halide emulsion materials.

The liquid used for carrying out the development of the photographic material may be applied in any way known to those skilled in the art, e.g. by dipping or spraying. According to a preferred embodiment the liquid used in the development is applied by meniscus coating in a tray device and the photographic material is led through conveying rollers whereby it is possible to apply only very small amounts of liquid, e.g. in the range of 20 to 60 ml per m2.

According to a particular embodiment applied in instant photography the developing liquid is made available in a liquid container, a so-called "pod" associated with the photographic silver halide emulsion material (see Neblette's Handbook of Photography and Reprography, 7th ed. Edited by John M. Sturge (1977) p. 282–285). Other techniques for providing processing liquid in situ in a photographic silver halide emulsion material operate with micro-capsules that are pressure and/or heat-senstive. Examples of such micro-capsules, their preparation and use are described in GB-P 1,034,437 and 1,298,194. In another technique applied for almost dry processing use is made of photographic materials incorporating the photographic processing substances in so-called thermosolvents that are substances solid at room temperature obtaining wetting capacity on melting by heating the photographic material. Examples of thermosolvents also called "heat-solvents" and their use in photographic materials are described e.g. in U.S. Pat. No. 3,438,776, published European Patent Application 0 120 306 and published DE-A 3 215 485. In the latter Patent Applications dye diffusion transfer materials incorporating developing agents and thermosensitive base releasing compounds are described that after image-wise exposure are heated, e.g. up to 110° C., to release a free base and are processed with plain water, optionally at elevated temperature.

For economic reasons the fixing of the undeveloped silver halide is preferably carried out in the temperature range of 15° C. to 20° C. but may be speeded up by increase of the temperature, so that steps (B) and (C) are carried out e.g. in the temperature range of 15° C. to 110° C.

A particularly rapid transfer of the silver complex compounds and silver sulphide formation in a receptor web or sheet proceeds at elevated temperature in the range of 30° to 110° C. In that temperature range the use of colloidal silica in the binder layer of the receptor element is advantageous to withstand these temperatures without causing sticking of the binder layer. The heating can be carried out by bringing the photographic material contacting the receptor sheet or web between heated plates or rollers or by irradiation with infra-red light or any other heating technique used in the art.

A final wash (rinsing) of the silver halide emulsion material after its contact with the present receptor element, e.g. sheet or web, is not strictly necessary but may be beneficial if for some or other reason residual stain, e.g. due to residual developing agent has to be removed.

The process of the present invention can be applied in conjunction with any type of silver halide, e.g. silver chloride, silver bromide, silver chlorobromide, silver bromide-iodide or mixtures thereof. A survey of silver halide emulsion preparation, their chemical and spectral sensitisation and stabilisation against fog is given e.g. in Research Disclosure December 1978, item 17643 titled "Photographic silver halide emulsions, preparations, addenda, processing and systems".

The present invention is very advantageously applied for the fixing of lith-type emulsion materials which mainly contain silver chloride since silver chloride has the highest solubility in silver halide solvents.

Silver chloride emulsions having a silver chloride coverage corresponding with an amount equivalent to 3 g of silver nitrate per m2 can according to the present invention be freed from silver chloride in less than 30 s by contact with said sheet or web at 20° C.

By the presence of swellable hydrophilic colloidal substances in said receptor sheet or web it obtains sufficient liquid absorption power to act as a sponge making that the photographic material after its separation is left substantially dry, certainly when the contacting proceeds at elevated temperature. The consequential omission or shortening of a drying step is a real advantage at the benefit of rapid access and energy saving.

Photographic materials in the form of a sheet are preferably fixed in contact with receptor materials in sheet form, e.g., by conveying them in contact between pressure rollers as are present in classical diffusion transfer reversal apparatus some types of which are described in "Photographic Silver Halide Diffusion Processes" by André Rott and Edith Weyde, Focal Press—London—New York (1972) p. 242–256.

Photographic materials in the form of a strip are advantageously processed by contacting with a receptor web by supplying each of them from different spools between two parallel plates exerting some pressure to the contacting materials. By polishing the plates or coating them with polytetrafluoroethylene their friction is kept low so that a smooth passage of the contacting materials between the plates takes place. In connection herewith the attention is drawn to an apparatus suitable for web processing of pre-wetted photographic material and DTR-receptor material described in the already mentioned Neblette's Handbook of Photography and Reprography, p. 253–254 under the trade name DITRICON of HRB-Singer.

According to a practical embodiment a receptor web of the present invention is supplied from a spool in dry state and brought together with a still wet developed photographic material on another spool for the accomplishment of the transfer of the dissolved silver halide and scavenging of its silver ions in the web. Thereupon the web is peeled apart from the film and web and film are wound on separate spools. The film is optionally rinsed and dried before storage. An arrangement for rapid film or web processing is illustrated in the already mentioned book and André Rott and Edith Weyde, p. 156.

To obtain a very rapid moistening the surface of the receptor web or sheet may be coated or contain a wetting agent. Examples of particularly useful wetting agents are fluoroalkyl wetting agents, e.g. of the type described in Belgian Patent Specification No. 742,680 and the anionic wetting agents described in EP No. 0 014 008.

According to a special embodiment the present receptor web or sheet is adapted for the production of a "retained image" by a dye diffusion transfer process. For improving the transfer of (a) dye(s) the present receptor sheet or web contains also a mordanting agent for fixing the transferred dye(s).

A receptor element, e.g. sheet or web, according to the present invention for use in the production of a retained image by a dye diffusion transfer process and serving as silver halide fixing and dye receiving element contains on a support a water-absorbing receptor layer comprising a hydrophilic organic colloid as binding agent, a mordanting agent for fixing (a) dye(s), a silver halide complexing agent and a metal sulphide in dispersed form capable of precipitating silver ions as silver sulphide, said layer being free from silver halide developing agent, said metal sulphide being present in colloidal form with an average grain size below 0.1 μm at a coverage of at least 5 millimole per m2, and the coverage of said complexing agent being not lower than 0.5 millimole per m2.

Several embodiments of the dye diffusion transfer process are described by Christian C. Van de Sande in Angew. Chem. Int. Ed. Engl. 22 (1983) 191–209.

The terminology "retained image" is used e.g. in Research Disclosure (No. 17362) of December 1978 and relates to a dye diffusion transfer process wherein the image left (retained) in the photographic dye diffusion transfer material after image-wise removal of mobile or mobilized dye(s) is used as the final photographic product containing a silver image and dye image(s) in superposition. Such gives a considerable economy in silver comsumption since optical density is built up both by dye and silver metal. On bleaching the silver a monochrome or multicolour image can be obtained as retained image.

When anionic dyes have to be mordanted the water-absorbing layer used in the present receiving sheet or web contains cationic polymeric mordants as described e.g. in U.S. Pat. No. 4,186,014, wherein a particularly useful mordanting agent prepared from 4,4'-diphenylmethane diisocyanate and N-ethyldiethanolamine quaternized with epichlorohydrine is described. Other useful mordanting agents are described in U.S. Pat. Nos. 2,882,156, 2,484,430 and 3,271,147. The coverage of the mordanting agent is e.g. in the range of 0.1 to 5.0 g per m2. The mordanting agent when itself having binding properties may play the role of hydrophilic colloid binding agent in the receptor sheet or web according to the present invention.

According to a particular embodiment in a receptor element according to the present invention a mordanting agent is used to remove from the photographic material not only an ionic dye as is the case in a dye diffusion transfer process but is used to remove from common black-and-white photographic materials residual ionic chemicals, e.g. ionic residual oxidized or unoxidized developing agent, e.g. hydroquinone monosulphonate, spectral sensitizing dyes and/or filtering dyes to obtain a more white or cleaner image background. Such may be of interest for the removal of dyes from radiographic materials that contain dyes for improving image sharpness as described e.g. in U.S. Pat. No. 4,130,428 according to which dyes are used in the photographic element to reduce cross-over light in silver halide emulsion layers that are coated at both sides of a transparent support.

The following examples illustrate the present invention without, however, limiting it thereto. All ratios and parts are by weight unless otherwise stated.

EXAMPLE 1

Preparation of Colloidal Zinc Sulphide

In a 5 l beaker were put 300 g of $Na_2S.9H_2O$ in 1000 ml of distilled water. While vigourously stirring a solution of 400 g of $ZnSO_4.7H_2O$ in 1000 ml of distilled water were added to the sodium sulphide solution. After the addition stirring was continued for 10 min at room temperature (20° C.).

The formed colloidal precipitate was separated by filtering on a paper filter and washed on that filter with 1 l of distilled water. Thereupon washing was completed by mixing the precipitate with 2 l of distilled water and filtering again. The colloidal ZnS having an average grain size of 5 nm was kept in the form of a dispersion (slurry) containing 14 g of ZnS per 100 g. Yield of colloidal ZnS: 120 g.

Preparation of Receptor Sheet

A coating composition was made by 3 min high speed stirring of the following ingredients:

| | |
|---|---|
| ZnS slurry (prepared as described above) | 250 g |
| 7.5% aqueous polyvinyl alcohol (PVA) solution (polyvinyl acetate saponified up to a degree of 90% - viscosity of 4% aqueous solution at 20° C. being 55 mPa.s) | 540 ml |
| 30% aqueous colloidal silica dispersion (average grain size of the silica: 30 nm) | 70 ml |
| sodium thiosulphate | 16 g |
| distilled water | 100 ml |

Before coating 30 ml of a 5% aqueous solution of a wetting agent having the following structural formula: $F_{17}C_8SO_3^-.N^+(C_2H_5)_4$ were added to the obtained dispersion.

The coating composition was applied on a subbed polyethylene terephthalate support at a wet coating thickness of 50 μm.

The dried receptor layer contained per m2:

| | |
|---|---|
| ZnS | 8 mmole |
| $Na_2S_2O_3$ | 5 mmole |
| PVA | 2 g |
| colloidal silica ($SiO_2$) | 1 g |

Fixing Processing

A photographic paper material for use in phototype setting containing a gelatin—silver halide emulsion layer incorporating silver chloro-bromide-iodide grains (AgCl: 97.6 mole %, AgBr: 2 mole % and AgI: 0.4 mole %) at a coverage of silver halide equivalent with 2.7 g (0.0158 mole) of silver nitrate per m2 and having an average grain size of 0.42 μm and a gelatin to silver halide ratio of 1 (the silver halide being expressed as an equivalent amount of silver nitrate) and including as developing agent hydroquinone at a coverage of 0.80 g per m2 was provided.

A strip of said photographic paper material being in half of its surface area exposed through a step wedge was treated at 20° C. for 10 s with an alkaline activator solution having the following composition:

| | |
|---|---|
| NaOH | 30 g |
| $Na_2SO_3$ | 50 g |
| KBr | 2 g |
| ethylene diamine tetra-acetic acid Na-salt | 1.5 g |
| pH > 13. | |

The still wet photographic material was put with its emulsion layer side into contact with the above receptor sheet and kept in contact therewith between heated steel plates. At 50° C. fixing was complete by contact for 15 s and at 22° C. complete fixing required a contact time of 1 min. The non-exposed area became herewith completely free of silver and in the receptor sheet the area corresponding with said non-exposed area the silver content expressed as silver nitrate was equivalent to 2.7 g per m2.

When in the above receptor sheet the thiosulphate coverage was reduced to a 20th of the molar coverage of silver halide in the described photographic material, viz. was reduced to 0.8 millimole the fixing required 75 s at 50° C. and 5 min at 20° C.

EXAMPLE 2

A silver halide film material was provided containing a pure silver chloride emulsion having a silver chloride coverage equivalent with 1.85 g per m2, average grain size of 0.34 μm and a gelatin to silver halide ratio of 0.4 (the silver halide being expressed as an equivalent amount of silver nitrate). The film material contained developing agents as described in Example 1.

Said film was exposed and treated with an activator liquid as described in Example 1 but containing additionally 2 g per liter of sodium thiosulphate. Thereupon the film was contacted between pressure rollers with the receptor sheet having a composition as defined in the following Table 1. The contact was maintained for 1 or 2 min at 20° C.

In said Table 1 the coverage of ingredients in the receptor sheet expressed in mmole per m2 is given together with the actual contact time for fixing and the residual silver content in the non-exposed area of the film film is therein expressed in g of silver nitrate per m2. Said ingredients were the same as applied in Example 1.

TABLE 1

| Ingredients per m2 | Contact time (minutes) | Silver halide expressed as $AgNO_3$ per m2 in film after processing |
|---|---|---|
| 18 mmole of ZnS | 1 | 1.23 |
| 1 mmole of $Na_2S_2O_3$ | 2 | 0.80 |
| 5 g of gelatin (composition A) | | |
| 18 mmole of ZnS | 1 | 0.24 |
| 1 mmole of $Na_2S_2O_3$ | 2 | 0.06 |
| 2.5 g of PVA (composition B) | | |
| 18 mmole of ZnS | 1 | 0.16 |
| 1 mmole of $Na_2S_2O_3$ | 2 | 0.00 |
| 1 g of PVA | | |
| 1 g of $SiO_2$ (composition C) | | |

EXAMPLE 3

A silver halide film material was provided containing a 100% silver chloride emulsion having a silver chloride coverage equivalent with the amount of silver nitrate per m2 indicated in Table 2, an average grain size of 0.32 μm and a gelatin to silver halide ratio of 0.4 (the silver halide being expressed as an equivalent amount of silver nitrate). The film material contained as developing agent 0.14 g per m2 of 1-phenyl-4-methyl-3-pyrazolidinone.

Said film was exposed and treated with an activator liquid as described in Example 1 and was kept with pressure rollers at 35° C. for respectively 0.5, 1 and 2 min in contact with a receptor sheet having a composition as defined in the following Table 2.

In said Table 2 in column A the coverage of ingredients in the receptor sheet expressed in mmole per m2, in column C the actual contact time for fixing in minutes and in columns B and D the silver halide content in the non-exposed area of the film expressed as silver nitrate per m2 before and after contact is given respectively.

TABLE 2

| A | B | C | D |
|---|---|---|---|
| 18 mmole of ZnS | 1.78 | 0.5 | 0.51 |
| 1 mmole of $Na_2S_2O_3$ | | 1 | 0.09 |
| 1 g of PVA | | 2 | 0.00 |
| 1 g of $SiO_2$ | 2.91 | 0.5 | 1.13 |

TABLE 2-continued

| A | B | C | D |
|---|---|---|---|
| | | 1 | 0.86 |
| | | 2 | 0.07 |
| | 3.93 | 0.5 | 1.84 |
| | | 1 | 1.43 |
| | | 2 | 0.69 |
| 18 mmole of ZnS | 1.78 | 0.5 | 0.00 |
| 5 mmole of $Na_2S_2O_3$ | | 1 | 0.00 |
| 1 g of PVA | | 2 | 0.00 |
| 1 g of $SiO_2$ | 2.91 | 0.5 | 0.23 |
| | | 1 | 0.00 |
| | | 2 | 0.00 |
| | 3.93 | 0.5 | 0.60 |
| | | 1 | 0.04 |
| | | 2 | 0.00 |

EXAMPLE 4

Example 1 was repeated with the difference, however, that only composition sheet C was used which was compared in fixing capacity with a same receptor sheet wherein the colloidal ZnS was replaced by commercially available powdered ZnS (composition D) having an average grain size of 0.4 μm.

The fixing results after a contact time of 3 min at 50° C. are given in the following Table 3.

TABLE 3

| Composition | Silver halide coverage expressed as $AgNO_3$ per m2 before contact | Silver halide coverage expressed as $AgNO_3$ per m2 after contact (in non-exposed area) |
|---|---|---|
| C | 2.7 | 0.00 |
| D | 2.7 | 0.45 |

EXAMPLE 5

Preparation of Colloidal Zinc Sulphide

The preparaion proceeded as described in Example 1.

Composition of the Receptor Sheet

The dried receptor layer contained per m2:

| | |
|---|---|
| ZnS | 9 mmole |
| $Na_2S_2O_3$ | 1 mmole |
| MOR-P | 24.5 g |
| $SiO_2$ | 5 g |

MOR-P is a mordanting polymer for fixing anionic dyes applied in a dye diffusion process as described in U.S. Pat. No. 4,477,554 and is prepared as described in Example 1 of U.S. Pat. No. 4,186,014.

Fixing Processing

A photographic film sheet material for use in dye diffusion transfer processing being exposed through a step wedge and containing a silver chloride emulsion layer incorporating silver chloride in an amount equivalent with 0.24 g of silver nitrate per m2 and having an average grain size of 0.3 μm and a gelatin to silver halide ratio (the silver halide being expressed as an equivalent amount of silver nitrate) of 0.3 and including as reducing agents 3,5-dihydroxy-2-oxo-3-phenyl-6-propyl-7-n-hexadecyl-2,3-dihydro-benzo[b]furan as electron donor precursor (prepared according to U.S. Pat. No. 4,366,240 and described therein as compound 4) and 1-phenyl-4-methyl-3 pyrazolidinone (electron transfer agent) at a coverage of 0.5 g and 0.14 g per m2 respectively and containing 0.8 g per m2 of cyan dye redox-releasable compound (1C) of U.S. Pat. No. 4,477,554 was provided.

The thus composed film material was treated at 25° C. for 10 s with an alkaline activator solution having the following composition:

| | |
|---|---|
| sodium hydroxide | 28 g |
| distilled water | 50 ml |
| 1,4-bis-hydroxymethyl-cyclohexane | 32.5 ml |
| 2-methyl-2-propyl-1,3-propane diol | 25 g |
| trisodium orthophosphate | 25 g |
| potassium bromide | 1 g |
| sodium thiosulphate | 2 g |
| distilled water up to | 1 l |
| pH > 13 | |

The still wet photographic material was put with its emulsion layer side into contact with the above receptor sheet and pressed in contact therewith for 1 min at 35° C. between resilient rubber rollers. The thus treated photographic material became completely free of silver halide in the non-exposed area after a contact time of 20 s and had in the maximum density portions of the retained wedge print measured behind red filter a spectral density of 2.65 and in the minimum density portions of said print a spectral density measured behind the same filter of 0.11. After a contact time of 1 min that minimum density was reduced to 0.07.

EXAMPLE 6 (COMPARATIVE EXAMPLE)

Preparation of Receptor Sheet P

The preparation of the receptor sheet of Example 10 of U.S. Pat. No. 3,179,517 was repeated.

A solution (A) containing gelatin and other ingredients in the following proportions was made.

| | |
|---|---|
| N—methyl-p-aminophenol sulphate | 3.1 g |
| sodium sulphite | 45.0 g |
| hydroquinone | 12.0 g |
| sodium carbonate (anhydrous) | 67.5 g |
| potassium bromide | 1.9 g |
| dissolved in water | 400 ml |
| The obtained solution was mixed with: | |
| 20% aqueous gelatin solution | 125 ml |
| sodium thiosulphate.5 water | 60.0 g |
| Water was added to the mixture to make | 1 l |

A colloidal solution (B) was prepared by mixing in stoichiometric ratio solutions of zinc nitrate and sodium sulphide in the presence of gelatin so as to obtain an aqueous liquid composition containing 0.1N of zinc sulphide and 2.5% of gelatin.

100 ml of solution (A) were mixed with 100 ml of colloidal solution (B) and 0.4 g of potassium bromide.

The obtained mixture was coated to a thickness of 50 μm (0.002 inch) on a cellulose acetate support and dried.

In the dried sheet P the coverage of sodium thiosulphate was 0.95 g per m2, the coverage of zinc sulphide was 0.24 g per m2 and the coverage of gelatin was 1.25 g per m2.

Preparation of Receptor Sheet Q (used according to the present invention)

Sheet Q was prepared as sheet P with the difference however, that the developing agents, sodium sulphite, sodium carbonate and potassium bromide were left out of its composition.

In the dried sheet Q the coverage of sodium thiosulphate was 0.95 g per m2, the coverage of zinc sulphide was 0.24 g per m2 and the coverage of gelatin was 1.25 g per m2. The zinc sulphide was prepared as described in Example 1.

The receptor sheets P and Q were used in conjunction with the same thinly-coated silver chlorobromide (90 mole% of chloride) negative film (strips P' and Q' respectivelyl) having a silver halide coverage corresponding with 1.45 g of silver nitrate per m2.

The film strip was exposed through a step wedge.

The photographic strip P' was bathed for 5 s at 20° C. in a 1% solution of the surfactant $F_{17}C_8SO_3^-.N^+(C_2H_5)_4$ and after being squeegeed to remove adhering liquid was contacted at 20° C. for 15 s with receptor sheet P.

The photographic strip Q' was before contacting with receptor strip Q developed for 30 s at 20° C. in a developer containing per liter of distilled water:

| | |
|---|---|
| monomethyl-p-aminophenol sulphate | 1.5 g |
| hydroquinone | 6 g |
| sodium sulphite | 50 g |
| sodium carbonate | 32 g |
| potassium bromide | 2 g |
| pH > 10 | |

Before contacting with the receptor sheet the photographic material was led between rubber squeegee rollers to remove a substantial amount of adhering liquid. The contacting was effected at 20° C. between pressure rollers and lasted 15 s.

The maximum density ($D_{max}$) and minimum density ($D_{min}$) obtained in the photographic material strips P' and Q' respectively is listed in Table 4.

TABLE 4

| Strip | $D_{max}$ | $D_{min}$ |
|---|---|---|
| P' | 0.65 | 0.45 |
| Q' | 0.73 | 0.10 |

When the receptor sheet P before contact with photographic strip P' was stored for 24 h at 20° C. under relative humidity conditions of 50% it was not possible anymore to distinguish the wedge print from the image background. The results obtained with the receptor sheet Q' according to the present invention were not influenced by said storage.

When in the above receptor sheet Q the gelatin was replaced by the polyvinyl alcohol used in Example 1 $D_{max}$ was 0.73 and $D_{min}$ was 0.08.

EXAMPLE 7

Preparation of Colloidal Zinc Sulphide

In a 5 l beaker were put 300 g of $Na_2S.9H_2O$ in 1000 ml of distilled water. While vigorously stirring a solution of 400 g of $ZnSO_4.7H_2O$ in 1000 ml of distilled water were added to the sodium sulphide solution. After the addition stirring was continued for 10 min at room temperature (20° C.).

The formed colloidal precipitate was separated by suction-filtering and washed on the filter with 1 l of distilled water. For further washing the separated precipitate was introduced into 4 l of distilled water and stirred whereupon it was separated by filtering again. Yield of colloidal ZnS: 120 g.

The colloidal ZnS having an average grain size of 5 nm was kept in the form of a dispersion (slurry) containing 17 g of ZnS per 100 g.

250 g of the thus obtained zinc sulphide slurry were mixed with 1020 ml of distilled water, 15 ml of sodium hexametaphosphate (2% solution) serving as dispersant, and 15 ml of 8% aqueous sodium hydroxide solution. To that mixture 75 g of gelatin were added while stirring and stirring was continued for 45 minutes. Thereupon the temperature was raised to 40° C. and at that temperature the mixture was kept for 2 h and treated in a colloid mill. 0.3 ml of benzylalcohol were added to defoam the mixture which was stirred for a further 30 min at 40° C. The pH of the obtained colloidal dispersion was 5.5.

Preparation of Receptor Sheet

By high speed stirring a coating composition was made by adding at 36° C. to 900 g of the above obtained colloid dispersion the following ingredients:

| | |
|---|---|
| sodium thiosulphate | 16 g |
| sodium bromide | 5 g |
| 30% dispersion of colloidal silica | 5 ml |
| distilled water | 75 ml |

Before coating 12 ml of a 5% aqueous solution of a wetting agent having the following structural formula: $F_{17}C_8SO_3^-.N^+(C_2H_5)_4$ were added to the obtained dispersion.

The coating composition was applied at 36° C. on a subbed polyethylene terephthalate support at a wet coating thickness of 200 μm and dried.

Fixing Processing

A photographic paper material for use in phototype setting containing a gelatin-silver halide emulsion layer incorporating silver chloro-bromide-iodide grains (AgCl: 97.6 mole %, AgBr: 2 mole % and AgI: 0.4 mole %) at a coverage of silver halide equivalent with 2.7 g (0.0158 mole) of silver nitrate per m2 and having an average grain size of 0.42 μm and a gelatin to silver halide ratio (the silver halide being expressed as an equivalent amount of silver nitrate) of 1 and including as developing agent hydroquinone at a coverage of 0.80 g per m2 was provided.

A strip of said photographic material being in half of its surface area exposed through a step wedge was treated at 20° C. for 30 s with an alkaline activator solution having the following composition:

| | |
|---|---|
| NaOH | 30 g |
| $Na_2SO_3$ | 50 g |
| 25% aqueous solution of sodium tetradecyl sulphate (wetting agent) | 1 ml |
| distilled water up to | 1000 ml |
| pH > 13. | |

The still wet photographic material was put with its emulsion layer side into contact with the above receptor sheet and kept in contact therewith for 30 s at 20° C. The non-exposed area became herewith completely free of silver.

EXAMPLE 8

A strip of a photographic mlaterial containing a gelatin-silver halide emulsion layer incorporating silver chloro-bromide-iodide grains (AgCl: 97.9 mole %, AgBr: 1.8 mole % and AgI: 0.3 mole %) at a coverage of silver halide equivalent with 5.07 g of silver nitrate per m2 and having an average grain size of 0.25 μm and a gelatin to silver halide ratio of 0.5 (the silver halide being expressed as an equivalent amount of silver nitrate) and including as developing agent hydroquinone at a coverage of 0.80 g per m2 was in half of its surface area exposed through a step wedge and treated at 20° C. for 1 min with the alkaline activator solution of example 7.

The still wet photographic material was put with its emulsion layer side into contact with the receptor sheet prepared according to example 7 and kept in contact therewith for 80 s at 20° C. The non-exposed area contained after said treatment no silver anymore.

When in the above receptor sheet the sodium bromide was omitted from its coating composition a brown fog representing an optical density of 0.1 was produced in the non-exposed portions of the photographic material.

EXAMPLE 9

A gelatin-silver halide emulsion layer incorporating silver bromide-iodide grains (AgBr: 97 mole % and AgI: 3 mole %) at a coverage of silver halide equivalent with 3.9 g of silver nitrate per m2 and having an average grain size of 0.6 μm and a gelatin to silver halide ratio of 0.5 (the silver halide being expressed as an equivalent amount of silver nitrate) and including as developing agent hydroquinone at a coverage of 0.80 g per m2 was in half of its surface area exposed through a step wedge and treated at 20° C. for 1 min with the alkaline activator solution of example 7.

The still wet photographic material was put with its emulsion layer side into contact with the receptor sheet prepared according to example 7 and kept in contact therewith for 1 min at 20° C. The non-exposed area contained after said treatment no silver anymore.

I claim:

1. An ecologically clean method for fixing a developed photographic silver halide emulsion material which method comprises the steps of:

(A) developing an image-wise exposed silver halide emulsion layer with a diffusible developing agent in the presence of an aqueous alkaline liquid, (B) bringing the developed photographic material while still wet with the liquid of step (A) with its silver halide emulsion layer side in intimate contact with a water-absorbing layer of a receptor element, said layer comprising in an organic hydrophilic colloid binder, a silver halide solvent or complexing agent, and in dispersed form a metal sulphide to serve as silver ion scavenging agent, (C) maintaining said photographic material and receptor element in such contact to allow the transfer of dissolved complexed silver halide into said receptor element until the undeveloped silver halide in the exposed silver halide emulsion layer is substantially completely removed and a silver sulphide precipitate is formed in the receptor element, and (D) separating the photographic material from the receptor element, said water-absorbing layer containing said metal sulphide in colloidal form with an average grain size below 0.1 μm, and in an amount giving a sulphide ion coverage per sq. meter at least stoichiometrically equivalent with the silver ion coverage per sq. meter in the undeveloped photographic material, and the ratio of the molar coverage per sq. meter of said complexing agent to the molar coverage per m2 of silver halide in the unexposed photographic material being not lower than 1:20.

2. Method according to claim 1, wherein the receptor element is in web or sheet form.

3. Method according to claim 1, wherein the pH of said aqueous alkaline liquid is at least 9.

4. Method according to claim 1, wherein said aqueous alkaline liquid of step (A) is initially free from said diffusible developing agent, said agent being contained in the exposed photographic material before development.

5. Method according to claim 1, wherein the sulphide coverage per m2 is at least 50% in excess over the stoichiometric amount corresponding with the silver halide coverage per m2 in the undeveloped silver halide emulsion material.

6. Method according to claim 1, wherein said layers are contacted at an elevated temperature at which the metal sulphide has a higher solubility product in water than silver sulphide.

7. Method according to claim 6, wherein the metal sulphide is zinc sulphide or lead sulphide or a mixture of said sulphides.

8. Method according to claim 1, wherein the hydrophilic colloid binder is gelatin.

9. Method according to claim 1, wherein the silver complexing agent is sodium thiosulphate.

10. Method according to claim 9, wherein the sodium thiosulphate is applied at a coverage of 0.50 g to 5 g per m2.

11. Method according to claim 1, wherein said steps are carried out in the absence of potassium ions.

12. Method according to claim 1, wherein the steps (B) and (C) proceed in the presence of sodium bromide.

13. Method according to claim 12, wherein the sodium bromide is present in the water-absorbing layer of the receptor element.

14. Method according to claim 1, wherein the receptor element contains a wetting agent.

15. Method according to claim 1, wherein the steps (B) and (C) are carried out in the temperature range of 15° to 110° C.

16. Method according to claim 1, wherein said silver halide emulsion material contains at least one diffusible dye and said receptor material contains a dye mordanting agent for fixing dye diffusing thereto from said emulsion material.

17. Method according to claim 16, wherein said dye(s) is or are anionic dye(s) and the mordanting agent is a cationic polymeric mordanting agent.

18. Method according to claim 16, wherein the mordanting agent is present in the receptor at a coverage in the range of 0.1 to 5 g per m2.

* * * * *